US005197781A

United States Patent [19]

Tada

[11] Patent Number: 5,197,781

[45] Date of Patent: Mar. 30, 1993

[54] RECLINING APPARATUS

[76] Inventor: Hirofumi Tada, Higashizakura Building 606, 31-14 Izumi 3-chome, Higashi-ku, Nagoya-shi, Aichi-ken 461, Japan

[21] Appl. No.: 828,740

[22] Filed: Jan. 31, 1992

Related U.S. Application Data

[63] Continuation of Ser. No. 474,778, Mar. 15, 1990, abandoned.

[30] Foreign Application Priority Data

Jul. 18, 1988 [JP] Japan ..... 63-180130
Apr. 18, 1989 [JP] Japan ..... 1-99679

[51] Int. Cl.[5] ..... A47C 1/02

[52] U.S. Cl. ..... 297/323; 297/375; 297/16

[58] Field of Search ..... 257/25, 27, 28, 323, 257/16, 38, 375, 374, 420, 421

[56] References Cited

U.S. PATENT DOCUMENTS 184,597 11/1876 Davis ..... 297/323
289,611 10/1883 Hornung ..... 297/323
399,049 3/1889 Keller ..... 297/375
452,713 5/1989 Lewis ..... 297/375
642,010 1/1900 Seng ..... 297/375
646,107 3/1900 Karpen ..... 297/375
2,472,855 6/1949 Lorenz ..... 297/374 X
4,547,015 10/1985 Wakimoto ..... 297/16

FOREIGN PATENT DOCUMENTS 53232 12/1937 Netherlands ..... 297/27

*Primary Examiner*—Peter A. Aschenbrenner
*Attorney, Agent, or Firm*—Tarolli, Sundheim & Covell

[57] ABSTRACT

In the reclining apparatus of the invention(1, 21, 41, 61), the support member(2, 22, 42, 62), the seat member(3, 23, 43, 63) and the back rest member(5, 25, 45, 55, 75) are adjustably interconnected and the rod(11, 31, 51, 71) of the lock device(13, 33, 53, 73) is mounted on one of the support member, the seat member and the back rest member and fitted across another one of them. When a force is applied between the rod and the member through which the rod is fitted, all the positions of the above members are maintained.

When a person changes the posture, e.g., stretches himself, on the reclining chair(1, 21, 61) or the reclinable bed(41), the lock between the rod and the member through which the rod is fitted is released and the positions of the support member, the seat member and the back rest member are re-adjusted. After the re-adjustment, when the person seats or lies on the chair or the bed, the rod is again firmly engaged with the member.

2 Claims, 10 Drawing Sheets

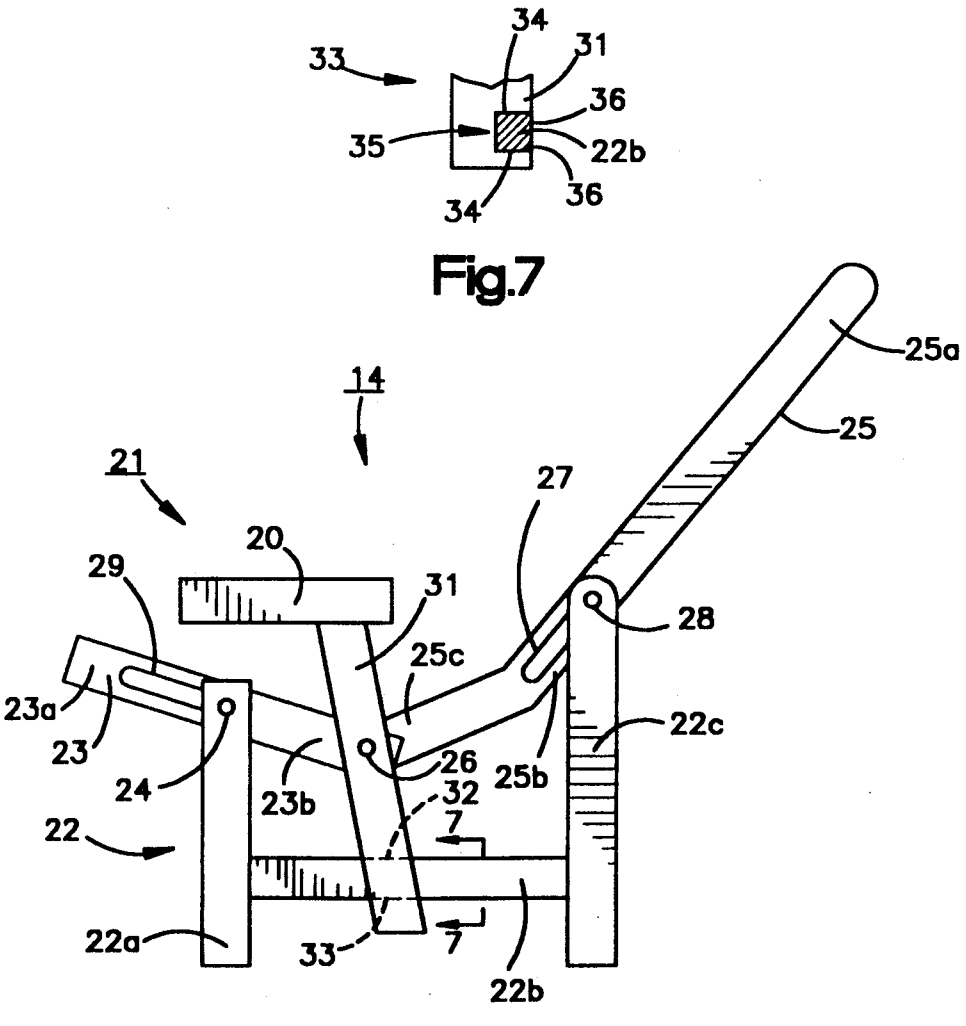
Fig.6
Fig.7
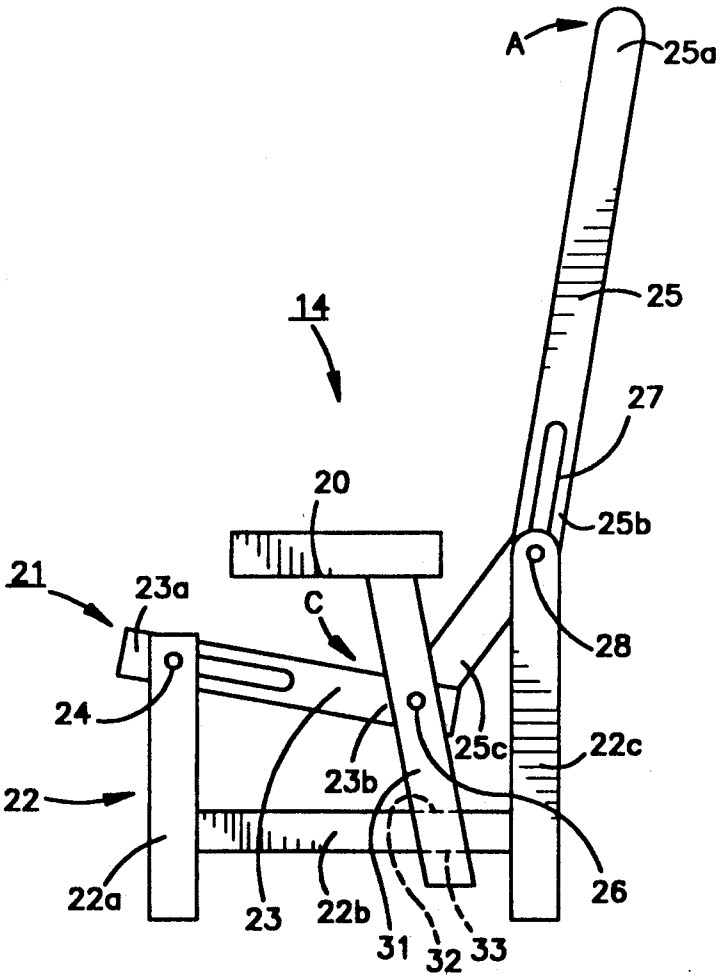
Fig.5

RECLINING APPARATUS

This is a continuation of copending application(s) Ser. No. 07/474,778 filed on Mar. 15, 1990, now abandoned.

TECHNICAL FIELD

This invention relates to reclining apparatus for locking a chair or a bed in the desirable reclining position.

BACKGROUND ART

General reclining apparatus includes a seat member supporting the lumbar region of a seated person, a support member, a back rest member supporting the back region and a lock device. The seat member is fixed to the support member and is articulatingly connected to the back rest member. The lock device provided between the support member and the seat member locks the seat member in a position and at an angle desired. The lock device generally used is a prop-support type or a serration-support type. The serration-support lock device locks the seat member at a certain set angle using serrations engaged each other and fixed with a screw.

The reclining apparatus or device is generally attached to a bed or a chair as an independent part, thus damaging the appearance of the furniture and making the price high. To attain the firm lock, the lock device is step-adjustable; a user chooses one of the angles set previously at certain intervals. The apparatus is hence incapable of maintaining the furniture in a desirable reclining position. Besides the apparatus can mainly be mounted only on chairs or beds made of metal.

A back-rest angle adjusting mechanism for a reclining chair is stepless adjustable reclining apparatus generally used for an automobile seat or ratchet type reclining apparatus. The former consists of mechanical parts relatively complicated and thus attains easy and accurate adjustment or regulation; but the disadvantage is high cost. The latter has a simple structure and is thus manufactured at a reasonable cost; but the disadvantage is poor adjustment or regulation. A further disadvantage common to both the mechanisms is that a seated person feels discomfort in the reclining position because the rear portion of the seat member maintains its original position whereas other portions move to change their positions.

An objective of the invention is to provide reclining apparatus favorably attached to furniture like a wooden chair or bed without damaging its appearance.

Another objective of the invention is to provide simply constructed and uncostly manufactured reclining apparatus which steplessly locks the furniture in a desirable reclining position.

DISCLOSURE OF THE INVENTION

Reclining apparatus according to the invention includes a seat member supporting the lumbar region of a seated person, a back rest member supporting the back region and adjustably connected to the seat member, a support member adjustably connected to both the seat member and the back rest member, and a rod functioning as a lock member mounted on one of the seat member, the back rest member and the support member and fitted across another one of them. When a force is applied only to the seat member, the lock member is locked to maintain the angle between the seat member and the back rest member. On the other hand, when a force is applied to both the seat member and the back rest member, the lock member is unlocked and moves to change the angle between the seat member and the back rest member.

BRIEF DESCRIPTION OF THE DRAWINGS

FIG. 5 is a right side view illustrating a reclining chair of a second embodiment according to the invention in the sitting position;

FIG. 6 is a right side view of the reclining chair of the second embodiment in the reclining position;

FIG. 7 is a sectional view taken on line VII—VII of FIG. 6;

BEST MODE FOR CARRYING OUT THE INVENTION

Figure 1C:
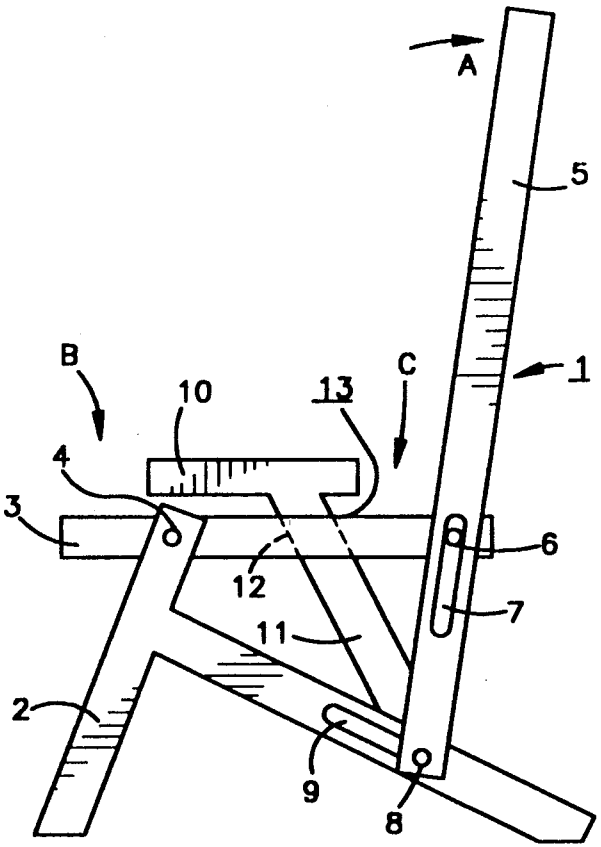
FIG. 1C is a right side view of the reclining chair of FIG. 1A.
Figure 1B:
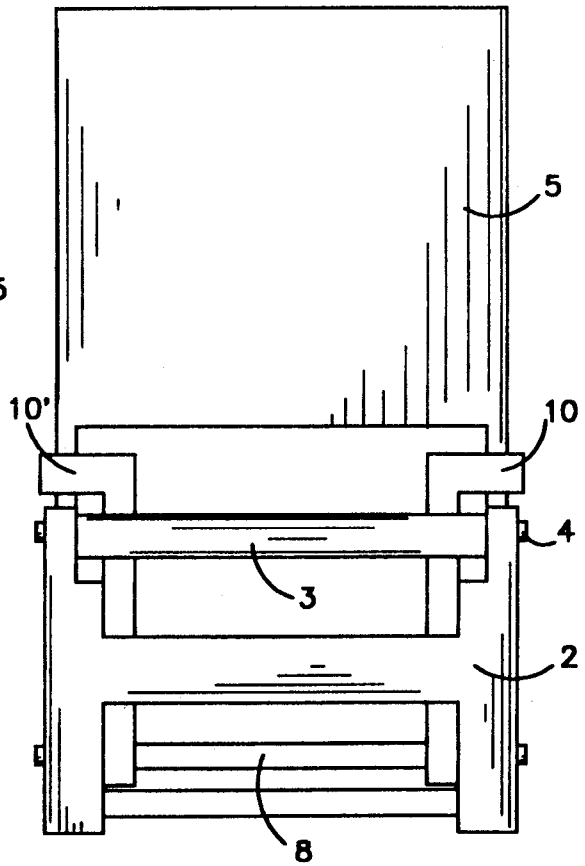
FIG. 1B is a front view of the reclining chair of FIG. 1A.
Figure 1A:
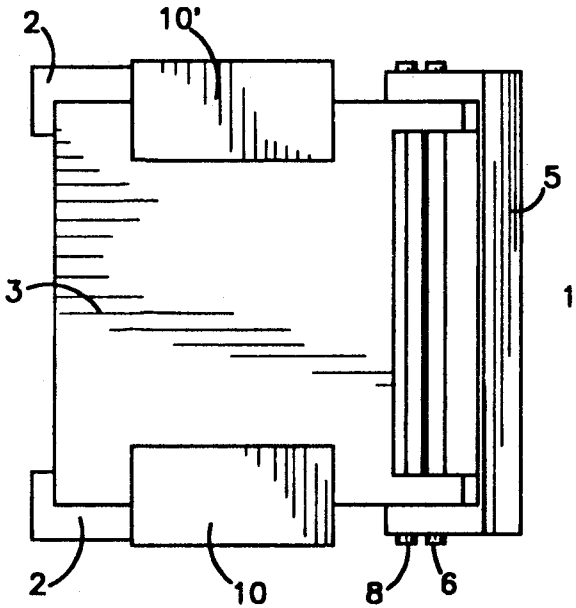
FIG. 1A is a top view illustrating a reclining chair of a first embodiment according to the invention in the sitting position.

First through fourth embodiments according to the invention are explained with the accompanying drawings.

FIGS. 1A through 1C and FIGS. 2A through 2C illustrate a wooden reclining chair 1 of a first embodiment. A seat member 3 supporting the lumbar region of a seated person is pivotably connected to a T-shaped support member 2 by a shaft 4. A back rest member 5 supporting the back region and the seat member 3 are adjustably connected to each other by a shaft 6 slidably fitted in a long aperture 7 provided on the middle portion of the longitude of the back rest member 5. The bottom of the back rest member 5 and the support member 2 are adjustably connected to each other by,; a shaft 8 slidably fitted in a long aperture 9. A rod or lock member 11 formed as an integral part of an arm rest 10 is secured on one end by the shaft 8 and is inserted across the seat member 3. FIGS. 3A and 3B and FIGS. 4A and 4B illustrate a lock device 13, for releasably locking the rod 11 and the seat member 3. In the lock device 13, rod 11 is fitted through an aperture 12, defined by surfaces 18, provided in the seat member 3. Surfaces 19 on the rod 11 and surfaces 18 of the aperture 12 are disposed to cooperate to relatively slide and also to provide frictional engagement.

The action of the first embodiment is now described. In the reclining chair 1 thus constructed, the support member 2, the seat member 3 and the back rest member 5 are adjustably interconnected, and the rod 11 of the lock device 13 is connected to the support member 2 and the seat member 3. But the rod 11 may be connected to any two of the support member 2, the seat member 3 and the back rest member 5 or to all of the three.

Figure 4A:
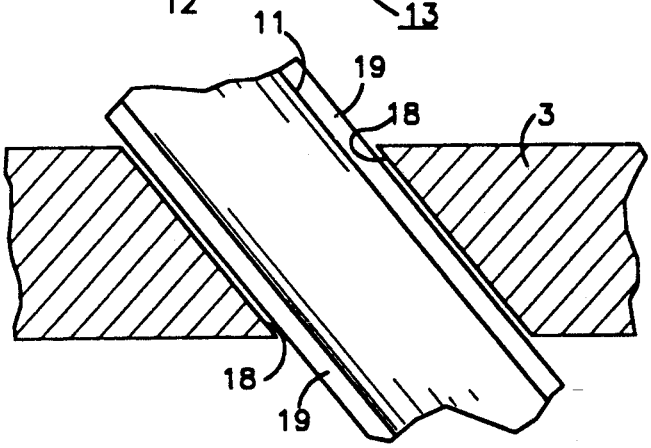
FIG. 4A is a sectional view taken on line IVA—IVA of FIG. 3B in the lock position of the lock device.
Figure 4B:
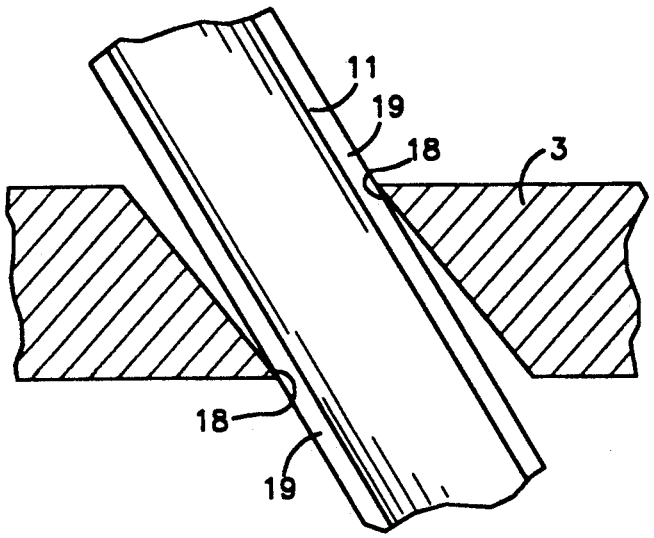
FIG. 4B is a sectional view taken on line IVA—IVA of FIG. 3B in the unlock position of the lock device.
Figure 8A:
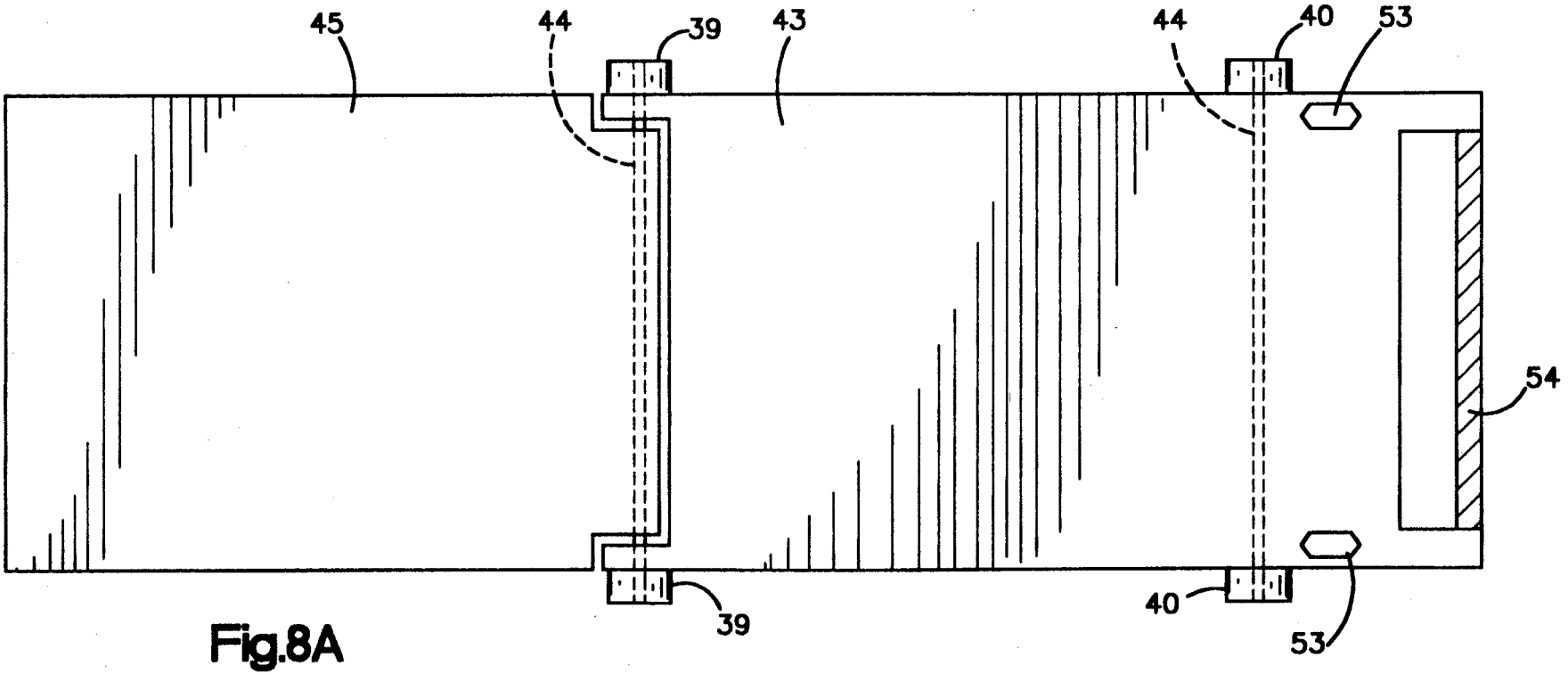
FIG. 8A is a top view illustrating a reclinable bed of a third embodiment according to the invention in the lying position.
Figure 8D:
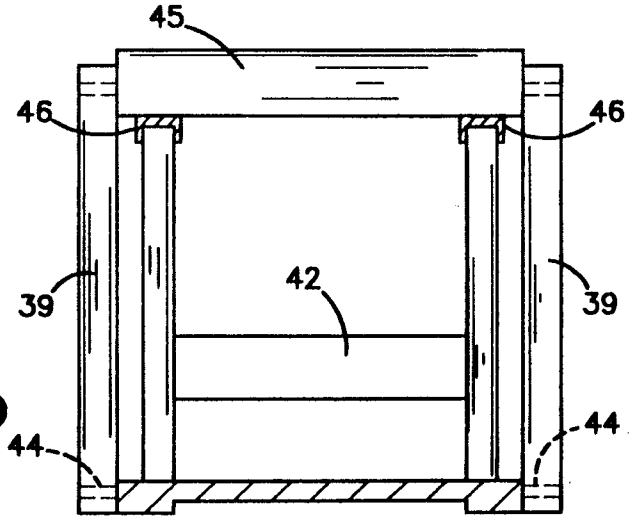
FIG. 8D is a front view of the reclinable bed of FIG. 8A.
Figure 8B:
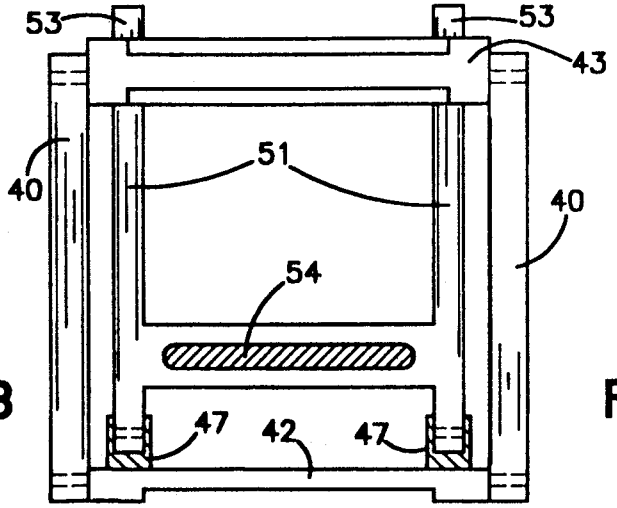
FIG. 8B is a rear view of the reclinable bed of FIG. 8A.
Figure 8C:
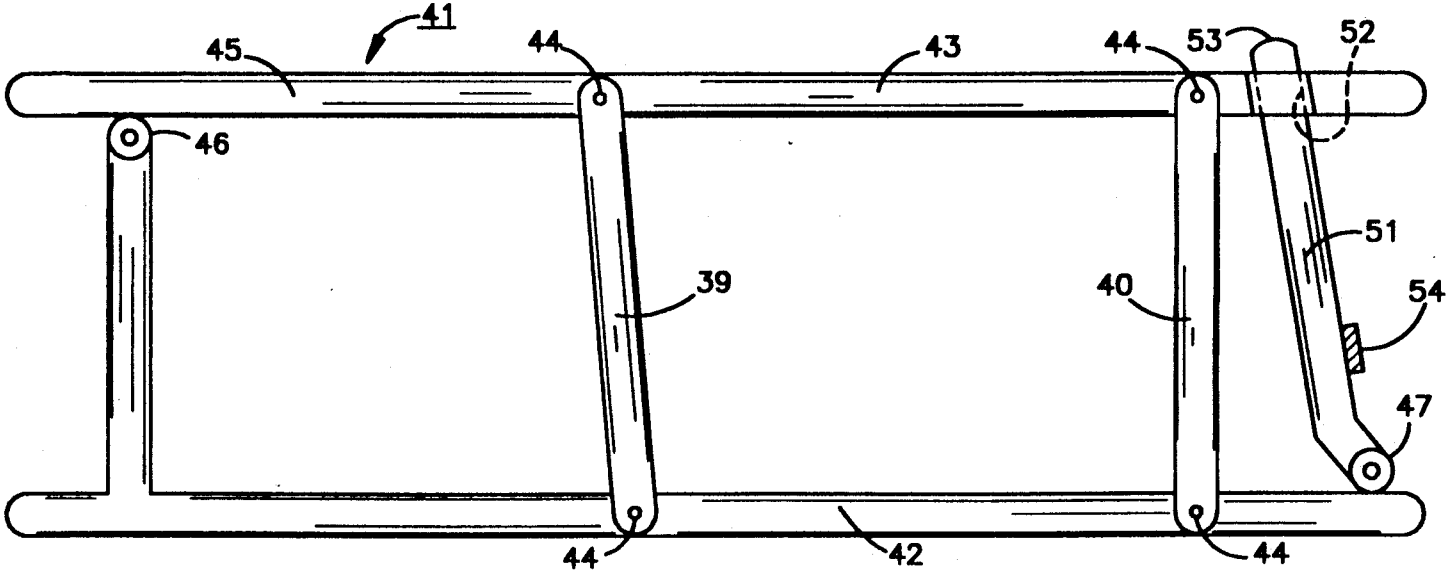
FIG. 8C is a right side view of the reclinable bed of FIG. 8A.

FIG. 4B shows the lock device in its lock position. Here the positions of the support member 2, the seat member 3 and the back rest member 5 are maintained. When a person is seated on the reclining chair 1 after setting the positions of the support member 2, the seat member 3 and the back rest member 5 as desired, the weight is applied onto the seat member 3 at location C (FIG. 1C). A certain force is applied to between the seat member rod 11 inserted across the seat member 3. The force causes the seat member 3 and the rod 11 to pivot relatively. The surfaces 18 and 19 cooperate to frictionally engage and lock. The rod 11 is then firmly engaged in the aperture 12 and the angle between the rod 11 and the seat member 3 is maintained.

Figure 2A:
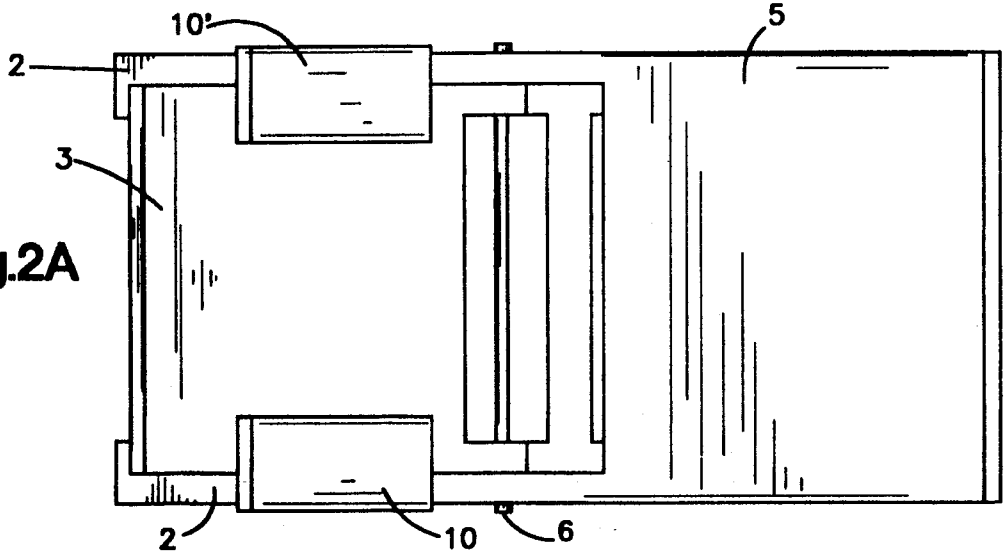
FIG. 2A is a top view of the reclining chair of the first embodiment in the reclining position.
Figure 2B:
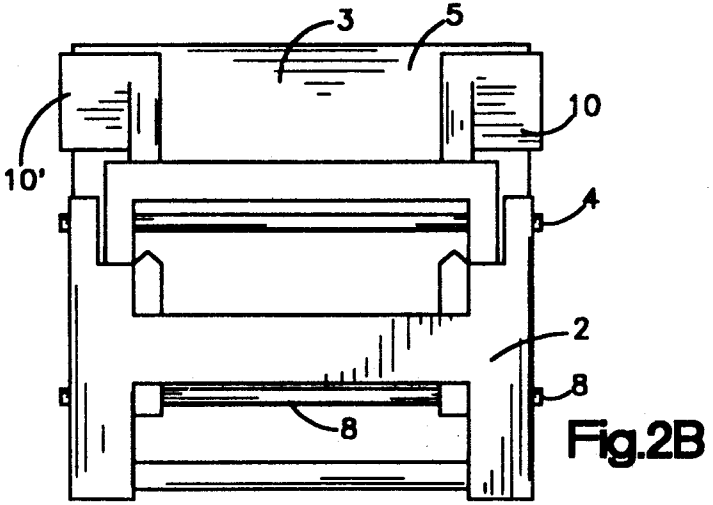
FIG. 2B is a front view of the reclining chair of FIG. 2A.
Figure 2C:
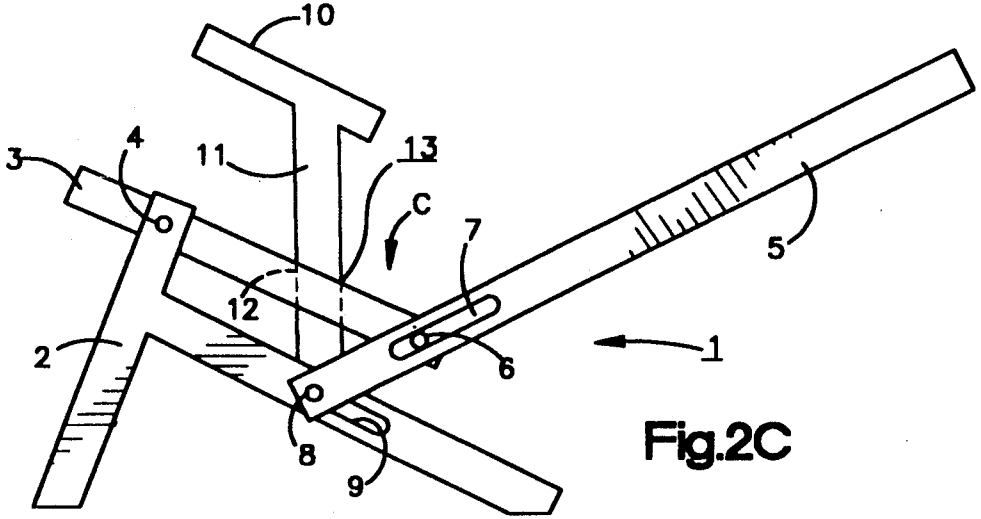
FIG. 2C is a right side view of the reclining chair of FIG. 2A.
Figure 3A:
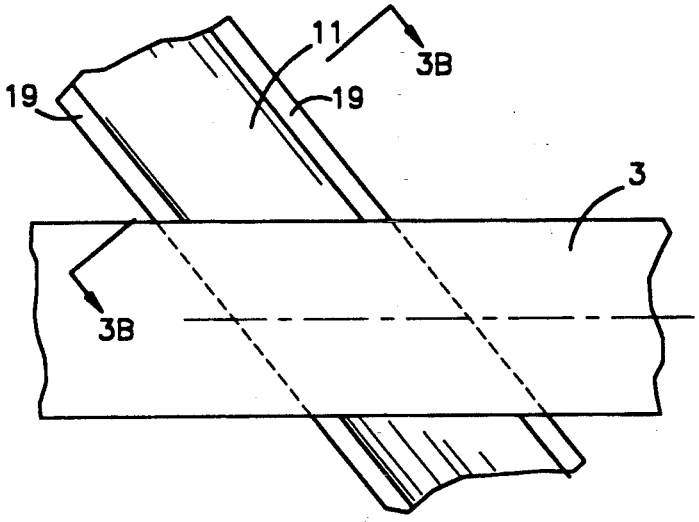
FIG. 3A is an enlarged right side view illustrating the lock device of the first embodiment.
Figure 3B:
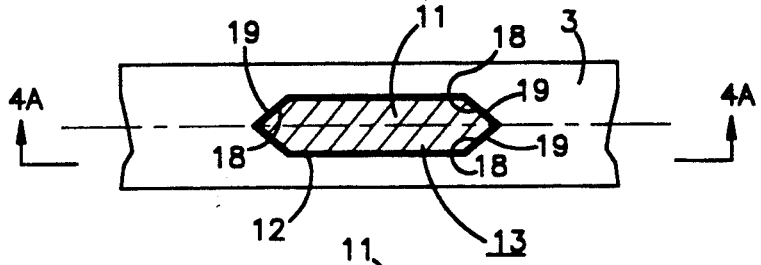
FIG. 3B is a sectional view taken on line IIIB—IIIB of FIG. 3A.

When a seated person stretches himself on the reclining chair 1, the force is applied to the positions A and B shown in FIG. 1C to release the lock between the seat member 3 and the rod 11. FIG. 4A shows the lock device in its unlock or releases position. Here the rod 11 is slidably moved in the aperture 12 of the seat member 3, and the positions of the support member 2, the seat member 3 i.e. the surfaces 18 and 19 are relatively slidable. The back rest member 5 can be re-adjusted. After the re-adjustment, the person is seated on the reclining chair 1 in the reclining position as shown in FIGS. 2A through 2C. The weight is again applied onto the seat member 3, at location C, and a certain, force is transmitted to between the seat member 3 and the rod 11 inserted across the seat member 3. The rod 11 is then firmly engaged in the aperture 12 and the angle between the rod 11 and the seat member 3 is maintained as shown in FIG. 4B.

The lock device 13 is not limited to the above construction but may have any other suitable constructions. For example, the rod 11 may be fitted in a groove, channel or seat provided on the seat member 3.

FIGS. 5 and 6 are right side views of a reclining chair 21 of a second embodiment. Vertically extending support elements 22*a* and 22*c* of a support member 22 are interconnected by a transversely extending support element 22*b*. The elements 22*a*, 22*b* and 22*c* partially define front, middle and rear portions, respectively, of the support member 22. The upper end of the support element 22*a* is adjustably connected to a seat member 23 by a shaft 24 slidably fitted in a long aperture 29 provided on the seat member 23. The seat member 23 has front and rear portions 23*a* and 23*b*, respectively. The long aperture 29 extends substantially parallel to a direction extending from the front portion 23*a* to the rear portion 23*b*.

A rod 31 supports an arm rest 20 and is pivotably connected to the seat member 23 and aback rest member 25 by a shaft 26. The rod 31 is slidably connected to the support element 22*b* at slide connection 32. A lock device 33 (FIG. 7) includes the slide connection 32. At the slide connection 32 a portion of the support element 22*b*, defined by surfaces 34, is fitted in a groove 35 defined by surfaces on the rod 31. The support element 22*b* is partially interposed between the surfaces 36.

The back rest member 25 includes upper, middle, and lower portions 25*a*, 25*b* and 25*c*, respectively. The back rest member 25 is bent upward at the middle portion 25*b* thereof and a long aperture 27 is provided above the bend. The long aperture 27 extends substantially parallel to a direction extending from the upper portion 25*a* to the lower portion 25*c*. The support element 22*c* is adjustably connected to the back rest member 25 by a shaft 28 slidably fitted in the long aperture 27.

The action of the second embodiment is now described. The lock device 33 is locked when the weight of a person seated in the reclining chair 21 is applied onto the seat member 23 at location C, as shown in FIG. 5, similar to the first embodiment. The lock-device 33 is released when the person seated in the reclining chair 21 stretches and applies force at location A, in a manner similar to the first embodiment. When the lock device 33 is unlocked, it moves leftward and the rod 31 thus moves leftward. The seat member 23 accordingly slides leftward and the back rest member 25 rotates clockwise to slide left-downward.

FIGS. 8A through 8D and FIG. 9 illustrate a reclinable bed 41 of a third embodiment. Each lower end of links 39 and 40 is rotatably connected to a support member 42 by each upper shaft 44, and each upper end of the links 39 and 40 is articulatingly connected to a seat member 43 by each lower shaft 44. The seat member 43 and the support member 42 are thus interconnected by the links 39 and 40. A back rest member 45 is articulatingly connected to the link 39 by the shaft 44 and the rear part of the back rest member 45 is supported by a roller 46 provided on one end of the support member 42. On end of a rod 51 is supported by the support member 42 via a roller 47 of the rod 51 and the other end thereof is inserted across the seat member 43. A lock device 53 is clearly seen in FIGS. 8A through 8D, wherein the rod 51 is fitted in a through hole 52 for the rod 51 provided in the seat member 43.

Figure 9:
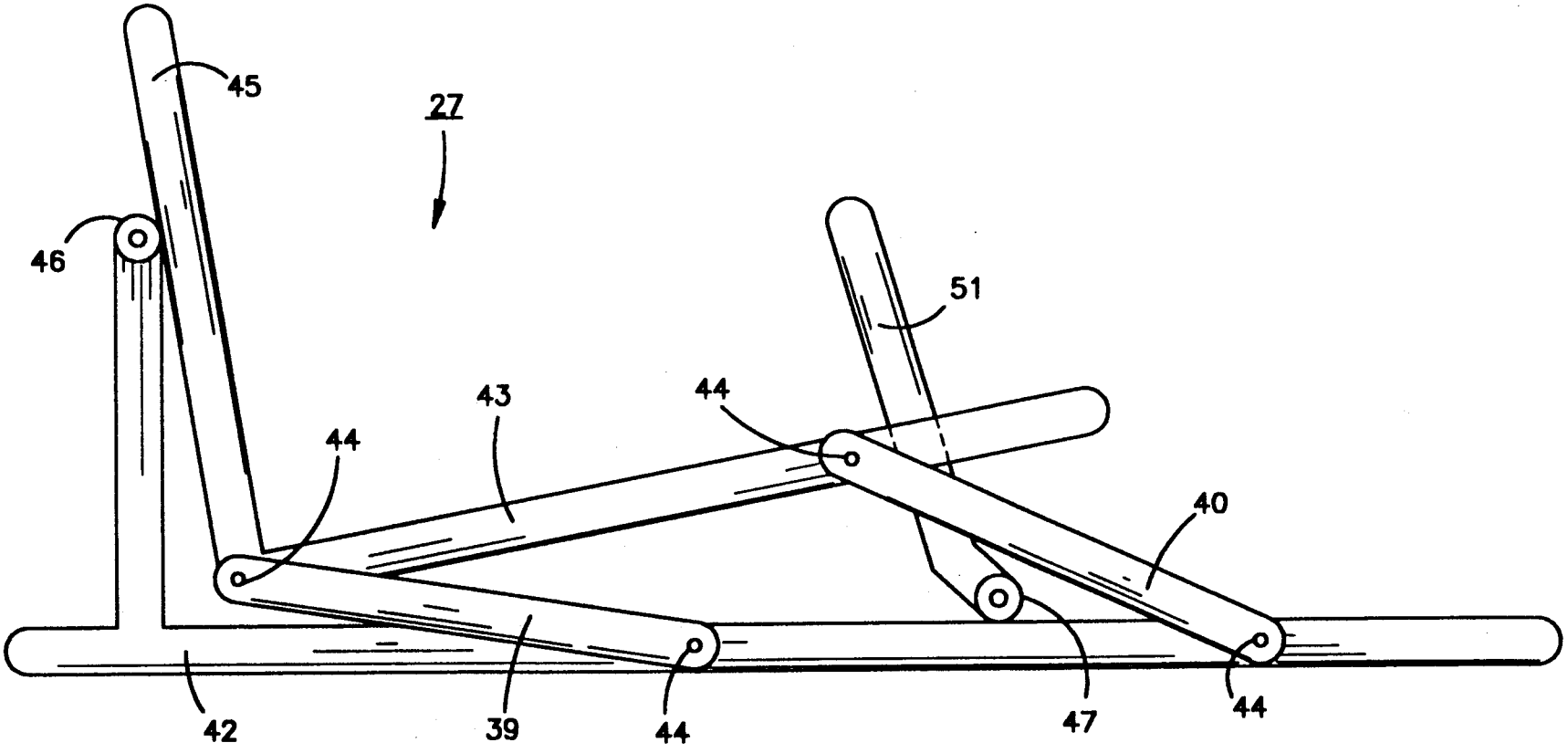
FIG. 9 is a right side view of the reclinable bed of the third embodiment in the reclining position.
Figure 10C:
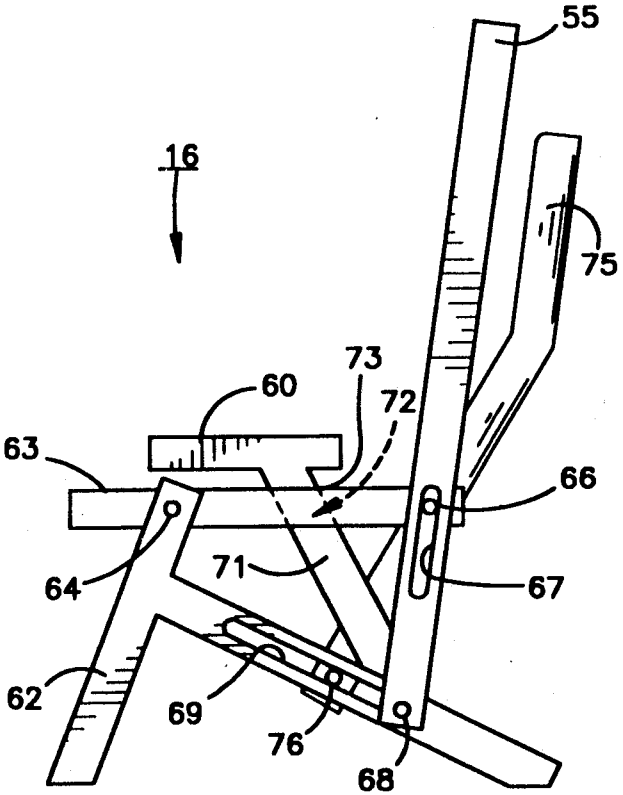
FIG. 10C is a right side view of the reclining chair of FIG. 10A.
Figure 10B:
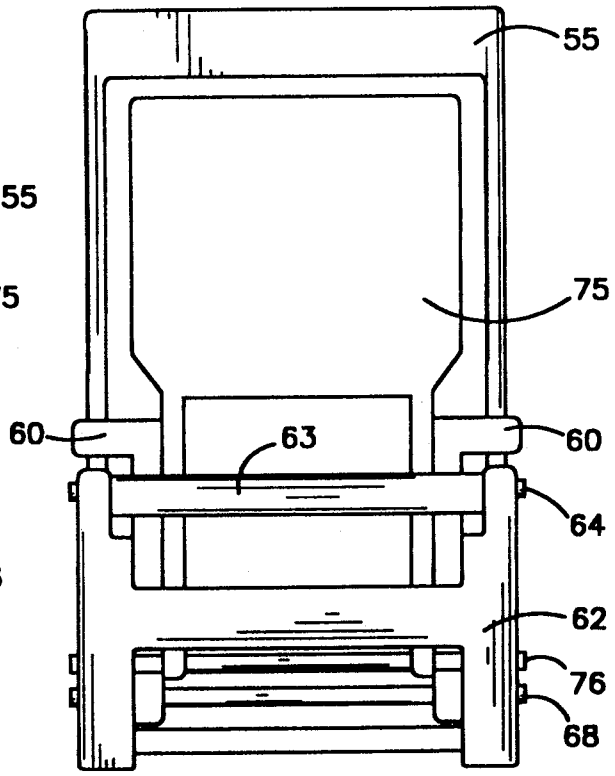
FIG. 10B is a front view of the reclining chair of FIG. 10A.
Figure 10A:
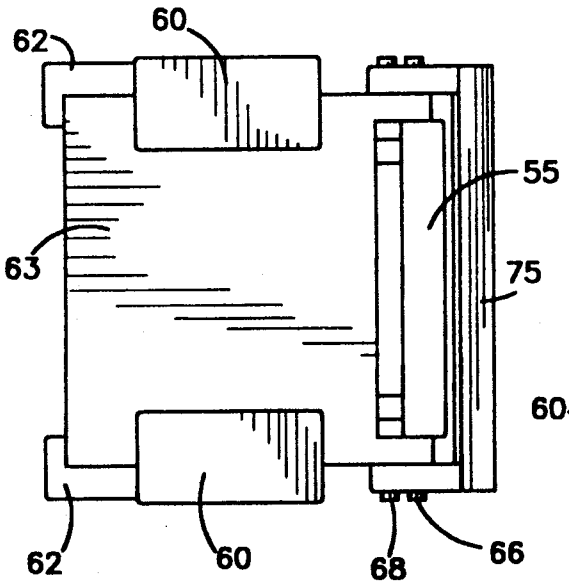
FIG. 10A is a top view illustrating a reclining chair of a fourth embodiment according to the invention in the sitting position.
Figure 11B:
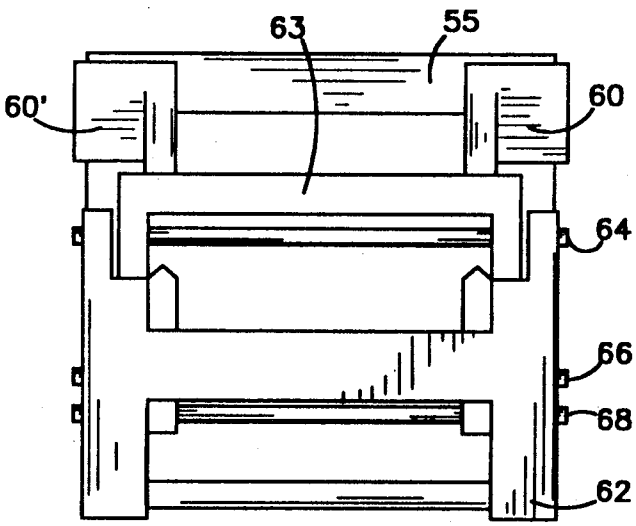
FIG. 11B is a front view of the reclining chair of FIG. 11A.
Figure 11A:
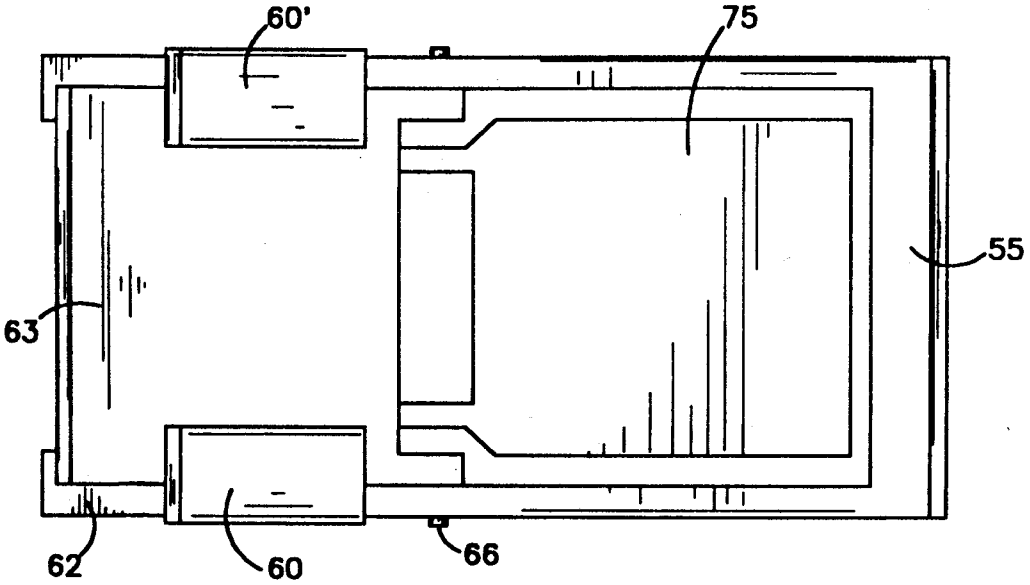
FIG. 11A is a top view of the reclining chair of the fourth embodiment in the reclining position.
Figure 11C:
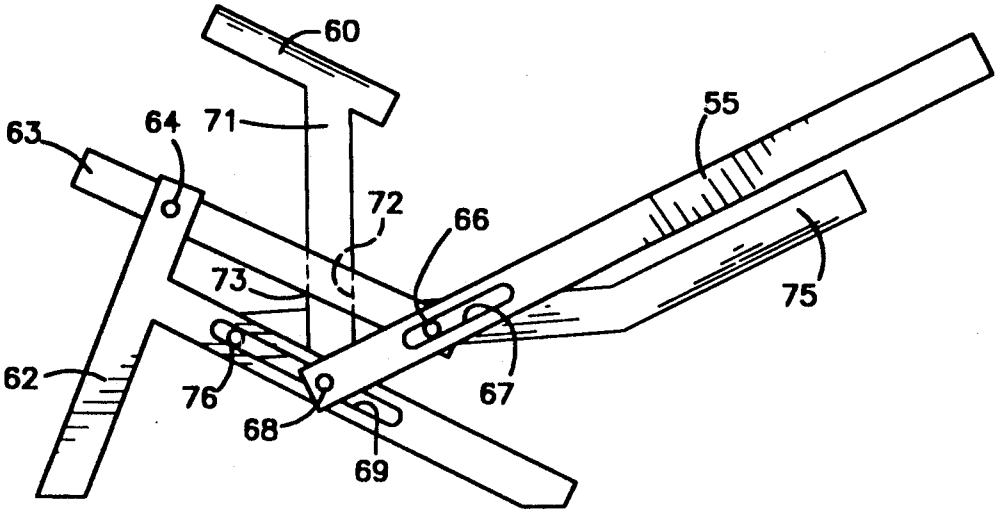
FIG. 11C is a right side view of the reclining chair of FIG. 11A.
Figure 12:
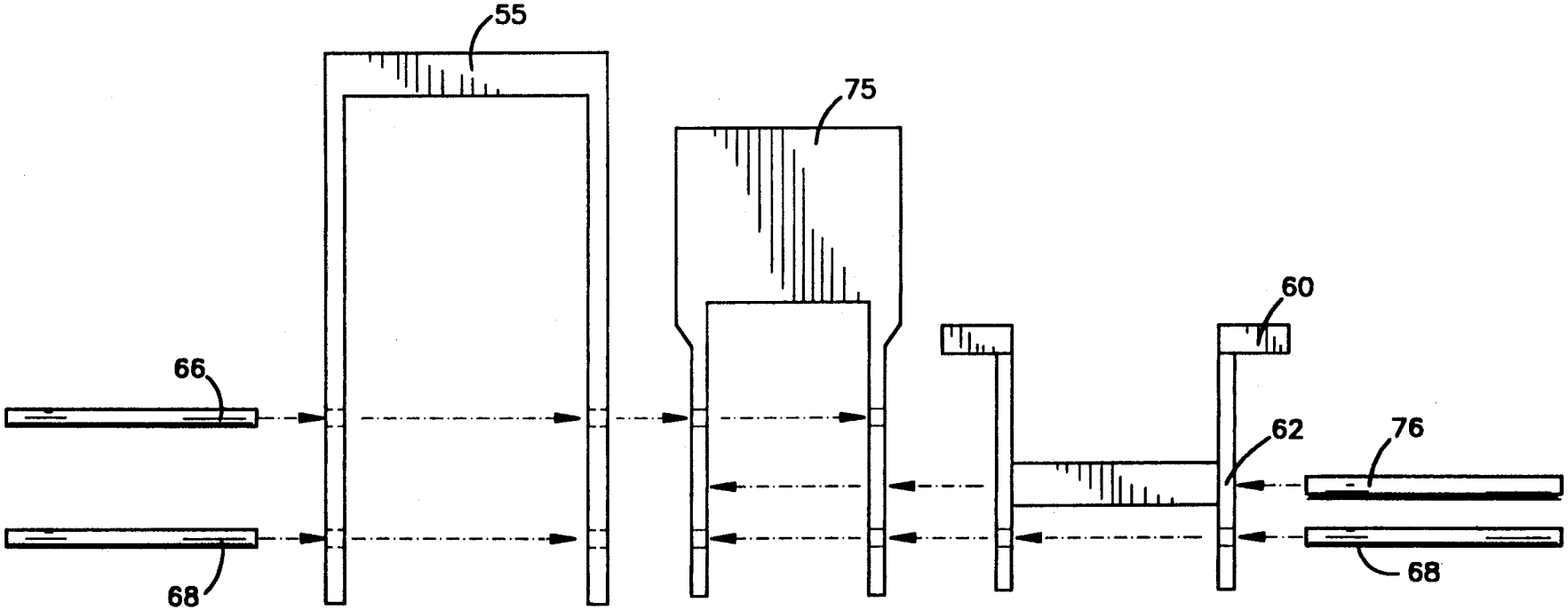
FIG. 12 is a front view illustrating the method for assembling the reclinable chair of the fourth embodiment.

When a person lies on the back rest member 45 and the seat member 43, the weight works to lock the lock device 53 and the reclinable bed 41 is maintained in the lying position as shown in FIGS. 8A through 8D. When a handle 54 provided on the lower portion of the rod 51 is pushed leftward of FIG. 8C, the roller 47 slides on the surface of the support member 42 and the seat member 43 rotates anticlockwise to move left-downward. The lock device 53 then moves downward, the links 39 and 40 rotate anticlockwise to move downward and the seat member 43 accordingly forms a V shape with the back rest member 45. The reclinable bed 41 is now in the reclining position as shown in FIG. 9. When the left end of the seat member 43 is pulled upward and the right end thereof is pulled rightward in the reclinable bed 41 of FIG. 9, the reclinable bed 41 returns to the lying position shown in FIGS. 8A through 8D.

FIGS. 10A through 10C, FIGS. 11A through 11C and FIG. 12 illustrate a reclining chair 61 of a fourth embodiment according to the invention. The main structure of the reclining chair 61 is similar to that of the chair 1 of the first embodiment; only the structure and the function different from those of the chair 1 are thus explained here.

A second back rest member 75 is provided in parallel with a first back rest member 55 both to support the back region of a seated person. The lower portion of the second back rest member 75 is adjustably connected to a T-shaped support member 62 by a shaft 76 slidably fitted in a long aperture 69 provided on the support member 62. The middle portion of the second back rest member 75 is adjustably connected to the rear portion of a seat member 63 by a shaft 66 slidably fitted in a long aperture 67 provided on the first back rest member 55.

The action of the fourth embodiment is now described. When a person is seated on the reclining chair 61 thus constructed, the weight is applied to the rear end of the seat member 63 and the second back rest member 75. Here the seat member 63 and a portion 72 of a rod 71 inserted across the seat member 63 are interconnected at slide connection 73 of a lock mechanism 74, which is locked. The weight applied to the second back rest member 75 gives no effect on the rod 71 and thus both the back rest member 55 and 75 maintain their angles.

When a seated person half lifts the lumbar region from the rear portion of the seat member 63 and stretches himself on the reclining chair 61, a backward force is applied to the first back rest member 55 supporting the shoulders and the head of the seated person. Here the slide connection 73 between the seat member 63 and the rod 71 is unlocked, and the first and second back rest members 55 and 75 accordingly move backward to attain desirable reclining angle and position. After the adjustment, when the person is seated on the reclining chair 61 in the reclining position shown in FIGS. 11A through 11C, the weight is again applied to only the seat member 63 and the second back rest member 75, and the seat member 63 and the rod 71 are relocked.

When a seated person places the hand on an arm rest 60 and half lifts the back and lumbar regions from both the back rest members 55 and 75 and the seat member 63, the slide connection 73 between the seat member 63 and the rod 71 is released and both the back rest members 55 and 75 return to their sitting positions.

As mentioned above, any complicated controls for reclining such as manual controls are not required to change the sitting position on the reclining chair 61. The reclining chair is in the normal position when a person is seated. When the seated person stretches himself for reclining, the reclining chair is automatically changed to be in the reclining position. Additionally, the reclining chair 61 is easily constructed and manufactured at a reasonable cost.

When a person is seated on the reclining chair thus constructed, the weight is applied to the seat member and the second back rest member. Here the seat member and a rod are locked. The weight applied to the second back rest member gives no effect on the rod and thus both the back rest members maintain their angles.

When a seated person half lifts the lumbar region from the rear portion of the seat member and stretches himself on the reclining chair, a backward force is applied to the first back rest member supporting the shoulders and the head of the seated person. Here the seat member and the rod are unlocked, and the first and second back rest members and accordingly move backward to attain desirable reclining angle and position. After the adjustment, when the person is seated on the reclining chair in the reclining position, the weight is again applied to only the seat member and the second back rest member, and the seat member and the rod are re-locked.

When a seated person places the hand on an arm rest and half lifts the back and lumbar regions from both the back rest members and the seat member, the lock between the seat member and the rod is released and both the back rest members and return to their sitting positions.

As mentioned above, any complicated controls for reclining such as manual controls are not required to change the sitting position on the reclining chair 61. The reclining chair is in the normal position when a person is seated. When the seated person stretches himself for reclining, the reclining chair is automatically changed to be in the reclining position. Additionally, the reclining chair 61 is easily constructed and manufactured at a reasonable cost.

INDUSTRIAL APPLICABILITY

In the reclining apparatus of this invention, the support member, the seat member and the back rest member are adjustably interconnected and the rod of the lock device is mounted on one of the support member, the seat member and the back rest member and fitted across another one of them. When a force is applied between the rod and the member through which the rod is fitted, all the positions of the above members are maintained.

When a person changes the posture, e.g., stretches himself, on the reclining chair or the reclinable bed, the lock between the rod and the member through which the rod is fitted is released and the positions of the support member, the seat member and the back rest member are re-adjusted. After the re-adjustment, when the person seats or lies on the chair or the bed, the rod is again firmly engaged with the member.

The reclining apparatus according to the invention is easily locked in a desirable position and also easily unlocked only by using the rod functioning as the lock device together with the support member, the seat member or the back rest member. The reclining apparatus of the invention is manufactured at a reasonable cost and is also attached to a wooden chair or bed without damaging its appearance. The apparatus maintains the furniture in a desirable reclining position.

I claim:

1. An adjustable chair for supporting a human body, said chair comprising:

a seat member for supporting a lumbar portion of the human body, said seat member having front and rear portions, said seat member having surfaces defining a first elongate slot, said first elongate slot having a longitudinal extent substantially parallel to a direction extending from said front portion of said seat member to said back portion of said seat member;

a back member connected to said seat member for supporting a back portion of the human body, said back member having upper, middle and lower portions, said middle portions of said back member having surfaces defining a second elongate slot, said second elongate slot having a longitudinal axis substantially parallel to a direction extending from said upper portion of said back member to said lower portion of said back member;

a support member connected to said seat member and said back member for supporting said seat member and said back member, said support member having front, middle and rear portions;

first shaft means extending from said front portion of said support member through said first elongate slot in said seat member for transmitting a portion of a weight force applied against said seat ember to said support member, said first shaft means connecting said seat member to said support member, said first shaft means extending substantially perpendicular to the longitudinal extent of said first elongate slot, said seat member being pivotable relative to said support member about said first shaft means, said first shaft means being slidable along the longitudinal extent of said first elongate slot to permit sliding movement of said seat ember relative to said support member;

second shaft means extending from said rear portion of said support member through said second elongate slot in said back member for transmitting a portion of a weight force applied against said back member to said support member, said second shaft means connecting said back member to said support member, said second shaft means extending substantially perpendicular to the longitudinal extent of said second elongate slot, said back member being pivotable relative to said support member about said second shaft means, said second shaft means being slidable along the longitudinal extent of said second elongate slot to permit sliding movement of said back member relative to said support member;

third shaft means extending from said rear portion of said seat member to said lower portion of said back member, said third shaft means connecting said seat member to said back member, said third shaft means extending substantially perpendicular to the direction extending from said front portion of said seat member to said back portion of said seat member and extending substantially perpendicular to the direction extending from said upper portion of said back member to said lower portion of said back member, said seat member being pivotable relative to said back member about said third shaft means; and a lock member for preventing relative movement of said seat member, said back member and said support member, said lock member being attached to said third shaft means, said third shaft means connecting said lock member to said seat member and said back member, said lock member having first and second surfaces positioned adjacent to first and second surfaces, respectively, of said middle portion of said support member, said middle portion of said support member being partially interposed between said first and second surfaces of said lock member, said lock member transferring a portion of weight force applied against said seat member and a portion of weight force applied against said back member to said support member, said first and second surfaces of said lock member being spaced apart a sufficient distance to permit said lock member to slightly tilt from a first tilt position to a second tilt position relative to said middle portion of said support member.

2. An adjustable chair as set forth in claim 1, wherein when said lock member is in the first tilt position, said first and second surfaces of said lock member are slidable along said middle portion of said support ember, when said lock member is in the second tilt position, said first and second surfaces of said lock member are engaged against said first and second surfaces, respectively, of said middle portion of said support with sufficient force to prevent said first and second surfaces of said lock member from sliding along said middle portion, said lock member moves relative to said middle portion of said support member upon sliding of said first and second surfaces of said lock member along said middle portion of said support member, said seat member and said back member to pivot relative to each other and to the lock member upon movement of said lock member relative to said middle portion of said support member, said seat member and said back member move relative to said support member upon movement of said lock member relative to said middle portion of said support member.

* * * * *

UNITED STATES PATENT AND TRADEMARK OFFICE

CERTIFICATE OF CORRECTION

PATENT NO. : 5,197,781

DATED : March 30, 1993

INVENTOR(S) : Hirofumi Tada

It is certified that error appears in the above-identified patent and that said Letters Patent is hereby corrected as shown below:

Column 7, line 8, change "axis" to --extent --.

Column 7, line 19, change "ember" to -- member --.

Column 7, line 28, change "ember" to -- member --.

Column 8, line 32, change "ember" to -- member --.

Column 8, line 43, delete "to" (first occurrence).

Signed and Sealed this

Fourth Day of January, 1994

*Attest:*

Bruce Lehman

BRUCE LEHMAN

*Attesting Officer*

*Commissioner of Patents and Trademarks*